US011530170B2

(12) United States Patent
Sherman et al.

(10) Patent No.: US 11,530,170 B2
(45) Date of Patent: Dec. 20, 2022

(54) MATERIAL AND METHOD OF MANUFACTURE FOR ENGINEERED REACTIVE MATRIX COMPOSITES

(71) Applicant: POWDERMET, INC., Euclid, OH (US)

(72) Inventors: Andrew J. Sherman, Mentor, OH (US); Brian P. Doud, Cleveland Heights, OH (US)

(73) Assignee: POWDERMET, INC., Euclid, OH (US)

( * ) Notice: Subject to any disclaimer, the term of this patent is extended or adjusted under 35 U.S.C. 154(b) by 738 days.

(21) Appl. No.: 16/137,934

(22) Filed: Sep. 21, 2018

(65) Prior Publication Data

US 2019/0023630 A1 Jan. 24, 2019

Related U.S. Application Data

(62) Division of application No. 14/432,875, filed as application No. PCT/US2013/073988 on Dec. 10, 2013, now Pat. No. 10,392,314.

(60) Provisional application No. 61/735,246, filed on Dec. 10, 2012.

(51) Int. Cl.

| | |
|---|---|
| ***C06B 45/30*** | (2006.01) |
| ***C06B 27/00*** | (2006.01) |
| ***C06B 33/00*** | (2006.01) |
| ***C06B 43/00*** | (2006.01) |
| ***C06B 45/34*** | (2006.01) |

(52) U.S. Cl.

CPC ..... *C06B 45/30* (2013.01); *C06B 27/00* (2013.01); *C06B 33/00* (2013.01); *C06B 43/00* (2013.01); *C06B 45/34* (2013.01)

(58) Field of Classification Search

CPC ..... C06B 45/30

See application file for complete search history.

(56) References Cited

U.S. PATENT DOCUMENTS

| | | | |
|---|---|---|---|
| 4,063,907 | A | 12/1977 | Lee et al. |
| 4,134,759 | A | 1/1979 | Yajima et al. |
| 5,008,132 | A | 4/1991 | Kuo et al. |
| 5,171,419 | A | 12/1992 | Wheeler et al. |

(Continued)

FOREIGN PATENT DOCUMENTS

| | | |
|---|---|---|
| WO | 2006093519 | 9/2006 |

*Primary Examiner* — Aileen B Felton

(74) *Attorney, Agent, or Firm* — Ulmer & Berne LLP; Brian E Turung

(57) ABSTRACT

A high strength engineered reactive matrix composite that includes a core material and a reactive binder matrix combined in high volumes and with controlled spacing and distribution to produce both high strength and controlled reactivity. The engineered reactive matrix composite includes a repeating metal, ceramic, or composite particle core material and a reactive binder/matrix, and wherein the reactive/matrix binder is distributed relatively homogeneously around the core particles, and wherein the reactivity of the reactive binder/matrix is engineered by controlling the relative chemistry and interfacial surface area of the reactive components. These reactive materials are useful for oil and gas completions and well stimulation processes, enhanced oil and gas recovery operations, as well as in defensive and mining applications requiring high energy density and good mechanical properties.

22 Claims, 3 Drawing Sheets

(56) References Cited

U.S. PATENT DOCUMENTS

| | | | | |
|---|---|---|---|---|
| 5,184,662 | A | 2/1993 | Quick et al. | |
| 5,292,477 | A | 5/1994 | Chance et al. | |
| 5,453,293 | A | 9/1995 | Beane et al. | |
| 5,489,449 | A | 2/1996 | Umeya | |
| 5,614,320 | A | 3/1997 | Beane et al. | |
| 8,231,748 | B1 | 7/2012 | Higa | |
| 2011/0027547 | A1 | 2/2011 | Xun et al. | |
| 2011/0135953 | A1* | 6/2011 | Xu | B22F 1/16 427/217 |
| 2011/0160104 | A1* | 6/2011 | Wu | C04B 35/645 507/269 |
| 2012/0006562 | A1* | 1/2012 | Speer | E21B 23/04 166/373 |
| 2012/0247765 | A1* | 10/2012 | Agrawal | E21B 43/267 507/272 |
| 2013/0206425 | A1* | 8/2013 | Mazyar | E21B 34/063 166/376 |
| 2014/0144620 | A1* | 5/2014 | Zaiser | E21B 17/00 166/243 |

* cited by examiner

MATERIAL AND METHOD OF MANUFACTURE FOR ENGINEERED REACTIVE MATRIX COMPOSITES

The present invention is a divisional of U.S. patent application Ser. No. 14/432,875 filed Apr. 1, 2015, which is a 371 filing of PCT/US2013/073988 filed Dec. 10, 2013, which in turn claims priority on U.S. Provisional Patent Application Ser. No. 61/735,246 filed Dec. 10, 2012, which is incorporated herein by reference.

FIELD OF THE INVENTION

The present invention relates to the formation of multi-grain compacts or particles fabricated by a sintering process, which particles can be modified with one or more coatings applied to their surfaces to control the reactivity and/or mechanical properties of the compact. The present invention also relates to the production of a reactive composite having controlled reaction kinetics catalyzed by an external stimulus. The invention also relates to individual particles or agglomerates which have applied to their surface a second, discreet phase material of different composition from the particle which provides for at least partial control over the reaction with the core particle or the environment during exposure and/or which may be tailored by controlling the relative particle sizes and/or amounts to provide a controlled reactivity rate.

BACKGROUND OF THE INVENTION

Sintered products of inorganic non-metallic or metallic powders have been used in structural parts, wear parts, semiconductor substrates, printed circuit boards, electrically insulating parts, high hardness and high precision machining materials (e.g., cutting tools, dies, bearings, etc.), functional materials such as grain boundary capacitors, humidity sensors, and precision sinter molding materials, among other applications.

When inorganic non-metallic or metal powders are sintered to produce a product (often with the application of pressure), the starting particles are often blended with additives for such purposes as lowering the sintering/consolidation temperature and/or pressure, or modifying/improving the physical or mechanical properties of the resultant compact.

The current state of the art in metals and ceramics processing is to mill or blend additives and modifiers using a ball mill or attrition milling technology. More recent inventions utilize coprecipitation, atomization, or self-assembly to improve distribution and reaction controllability of these composite materials.

Applicant has proposed in a prior application a method for coating fine particles with coatings of ceramic and metallic materials. This is a process for applying coatings to particles in a continuous (or discontinuous, depending on application), pore-free manner. The current invention relates to the design and/or composition of matter for metal and/or ceramic particles to which have been applied a surface modifying layer or layers. When the core and claddings posses highly different properties, including electronegativity, free energy of formation, or oxidizing potential, the combination can be made to react in a controlled fashion in response to the imposition of an external stimulus, such as shear (e.g., impact), thermal (high temperature ignition), or catalysis or activation (addition of an electrolyte such as salt water or acid).

Umeya (U.S. Pat. No. 5,489,449) discloses the use of ultrafine sintering aids dispersed/coated onto the surface of ceramic particles using precipitation techniques. Umeya further describes a process for forming ultrafine ceramic particles through gas-phase nucleation which are then deposited onto the surfaces of ceramic particles. This process has inherent limitations in that it does not provide for a continuous, uninterrupted coating on the ceramic surface, and does not address reaction/interaction of the sintering aid with the particle itself. Umeya uses chemical reduction of copper oxide and other precursors, and the techniques described are not applicable to reactive systems due to temperature and chemical environments, and the reactivity of magnesium, aluminum, and other reactive metals.

Beane (U.S. Pat. Nos. 5,614,320 and 5,453,293) and others disclose a related process for controlling the end thermal (CTE, thermal conductivity) properties of a material by forming a coated particle having two materials that have distinctly different intrinsic properties. Such process allows for the production of a material with a property controlled by rules of mixture relationships between the limits set by the two materials consisting of the coating material and the core particle material.

Lee et al. (U.S. Pat. No. 4,063,907) discloses a process for producing smeared metal coatings on diamond particles to produce a chemically bonded coating on the diamond particles to improve adhesion in a matrix material.

Kuo et al. (U.S. Pat. No. 5,008,132) discloses a process for applying a titanium nitride coating to silicon carbide particles using a diffusion barrier interlayer to improve the wettability and to inhibit the reaction of the silicon carbide particles in a titanium metal matrix.

Gabor et al. (U.S. Pat. No. 5,405,720) discloses the use of refractory carbide and nitride coatings on abrasive particles.

Yajima et al. (U.S. Pat. No. 4,134,759) discloses the use of certain coatings on continuous SiC ceramic fibers that have an exterior carbon coating that increases the wettability in aluminum and aluminum alloys.

Wheeler et al. (U.S. Pat. No. 5,171,419) discloses the use of CoW and NiW interlayers on ceramic fibers for this purpose.

Chance et al. (U.S. Pat. No. 5,292,477) discloses an atomizing process for producing uniform distributions of grain growth control additives throughout the bulk of a particle.

Quick et al. (U.S. Pat. No. 5,184,662) disclose a related process for forming metal/ceramic composite particles that have a continuous cladding of the metal.

In each of these prior art references, the disclosures do not include the controlling of particle reactivity.

SUMMARY OF THE INVENTION

The present invention relates to the formation of multi-grain compacts or particles fabricated by a sintering process, which particles can be modified with one or more coatings applied to their surfaces to control the reactivity and/or the mechanical properties of the compact. The present invention also relates to the production of a reactive composite having controlled reaction kinetics catalyzed by an external stimulus, such as, but not limited to, an ignition source and/or environmental change (e.g., an electrolyte addition, etc.). The present invention creates particles so that the reaction kinetics can be at least partially controlled through the use of engineered building block repeating units combined with a solid and/or semi-solid state consolidation. The use of engineered particles or building block repeating units leads to more controllable, predictable, and/or lower cost fabrication of reactive composite parts using powder metallurgy techniques. The invention also relates to individual particles or agglomerates which have applied to their surface a second, discreet phase material of different composition from the particle which provides for at least partial control over the reaction with the core particle or the environment during exposure and/or which may be tailored by controlling the relative particle sizes and/or amounts (e.g., with third phase additions, etc.) to provide a controlled reactivity rate while simultaneously controlling mechanical and/or physical properties.

When the core and claddings possesses highly different properties, including electronegativity, free energy of formation, and/or oxidizing potential, the combination can be made to react in a controlled fashion in response to the imposition of an external stimulus, such as shear (e.g., impact, etc.), thermal (e.g., high temperature ignition, etc.), and/or catalysis or activation (e.g., addition of an electrolyte such as salt water or acid, etc.).

In one non-limiting aspect of the present invention, there is provided an engineered reactive matrix composite which includes a core material and a reactive binder matrix. In one non-limiting embodiment of the invention, the engineered reactive matrix composite includes a) a repeating metal or ceramic particle core material of about 30%-90% (e.g., 30%, 30.1%, 30.2%, 50%, 72%, . . . 89.98%, 89.99%, 90%) by volume and any value or range therebetween, and b) a reactive binder/matrix of about 10%-70% (e.g., 10%, 10.01%, 10.02%, . . . 69.98%, 69.99%, 70%) by volume and any value or range therebetween. The reactive/matrix binder can be distributed relatively homogenously around the core particles; however, other controlled arrangements are possible. The reactivity of the reactive binder/matrix can be engineered by controlling the relative interfacial surface area of the reactive components, through the selection of catalytic agents or accelerants, or through other techniques.

In still another non-limiting aspect of the present invention, there is provided a method of manufacturing reactive composites, which method includes the preparation of a plurality of engineered, reactive composite building blocks, and then consolidating these building blocks below the liquidus of the binder material using a combination of heat (e.g., 100° F.-1500° F., etc.) and pressure (e.g., 1.1-10 Atm, etc.), either simultaneously or in two separate steps. Generally, the binder and/or core material are above approximately 40% of the solidus temperature and below the liquidus temperature at the time such components of the reactive composite are combined together, although for certain systems much lower relative temperatures above room temperature can be used with elevated pressures. The techniques for consolidating the materials include, but are not limited to, powder forging or field-assisted sintering (e.g., spark plasma sintering, etc.), direct powder extrusion, or press and sinter techniques. Using press and sinter techniques, a porous perform can be fabricated with controlled density/particle loading to be further processed using infiltration (squeeze casting, pressureless infiltration, etc.) of a reactive metal matrix such as magnesium or aluminum.

It has been found that if the additive/modifier can be deposited as a thin, continuous coating onto the surface of the sintering powder to form an integral unit, the limitations of the prior art can be overcome, thus achieving simplified handling of powder materials, simplified production of a sintered compact with increased homogeneity, and improved and more repeatable performance/properties (particularly reactivity) can be achieved.

It is still another non-limiting aspect of the present invention, there is provided a powder structure of a metallic or inorganic non-metallic particle to which has been applied one or more coatings of a reactive inorganic material. The metallic or inorganic non-metallic particle is generally a non-reactive particle or a particle that is less reactive than the reactive inorganic material; however, this is not required. The metallic or inorganic non-metallic particle is generally not reactive with the reactive inorganic material; however, however, this is not required. Generally, 50% to 100% (e.g., 50%, 50.01%, 50.02% . . . 99.98%, 99.99%, 100%) and any valve or range therebetween of the outer surface of the metallic or inorganic non-metallic particle is coated with the reactive inorganic material. In one non-limiting embodiment, a continuous, uniform coating of a reactive inorganic material is coated onto the complete outer surface of the metallic or inorganic non-metallic particle. Such coating can be of a uniform or non-uniform thickness. In another and/or alternative non-limiting embodiment of the invention, the core is a high stiffness, relatively inert material, while the binder is a reactive material such as, but not limited to, an electropositive and/or easily oxidizable metal (e.g., magnesium, zinc, etc.).

A non-limiting object of the present invention is the provision of a multi-grain compacts and a process and method for forming the multi-grain compacts.

Another and/or alternative non-limiting object of the present invention is the provision of multi-grain compacts or particles fabricated by a sintering process, which particles can be modified with one or more coatings applied to their surfaces to control the reactivity and/or the mechanical properties of the compact.

Still another and/or alternative non-limiting object of the present invention is the provision of multi-grain compacts and a process and method for forming the multi-grain compacts having controlled reaction kinetics catalyzed by an external stimulus, such as, but not limited to, an ignition source and/or environmental change.

Yet another and/or alternative non-limiting object of the present invention is the provision of particles and the formation of particles wherein the reaction kinetics can be at least partially controlled through the use of engineered building block repeating units combined with a solid and/or semi-solid state consolidation.

Still yet another and/or alternative non-limiting object of the present invention is the provision of engineered particles or building block repeating units that have more controllable, predictable, and/or lower cost fabrication of reactive composite parts using powder metallurgy techniques.

Another and/or alternative non-limiting object of the present invention is the provision of individual particles or agglomerates which have applied to their surface a second, discreet phase material of different composition from the particle which provides for at least partial control over the reaction with the core particle or the environment during exposure and/or which may be tailored by controlling the relative particle sizes and/or amounts to provide a controlled reactivity rate.

Still another and/or alternative non-limiting object of the present invention is the provision of a method and process for coating fine particles with ceramic and metallic materials.

Yet another and/or alternative non-limiting object of the present invention is the provision of a method and process that involves the applying of coatings to particles in a continuous (or discontinuous, depending on application), pore-free manner.

Still yet another and/or alternative non-limiting object of the present invention is the provision of the design and/or composition of matter for metal and/or ceramic particles to which have been applied a surface modifying layer or layers.

Another and/or alternative non-limiting object of the present invention is the provision of coated particles wherein in the coating and particle have different properties, the combination of which can be made to react in a controlled fashion in response to the imposition of an external stimulus.

Still another and/or alternative non-limiting object of the present invention is the provision of an engineered reactive matrix composite which include a core material, and a reactive binder matrix, which engineered reactive matrix is a repeating metal or ceramic particle core material and a reactive binder/matrix.

Yet another and/or alternative non-limiting object of the present invention is the provision of an engineered reactive matrix composite which include a core material, and a reactive binder matrix, and the reactivity of the reactive binder/matrix can be engineered by controlling the relative interfacial surface area of the reactive components.

Still yet another and/or alternative non-limiting object of the present invention is the provision of a method of manufacturing reactive composites, which method includes the preparation of a plurality of engineered, reactive composite building blocks, and then consolidating these building blocks below the liquidus of the binder or core material.

Another and/or alternative non-limiting object of the present invention is the provision of adding an additive/modifier onto the surface of a powder to form an integral unit to achieve simplified handling of powder materials, simplified production of a compact with increased homogeneity and/or improved and more repeatable performance/properties.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
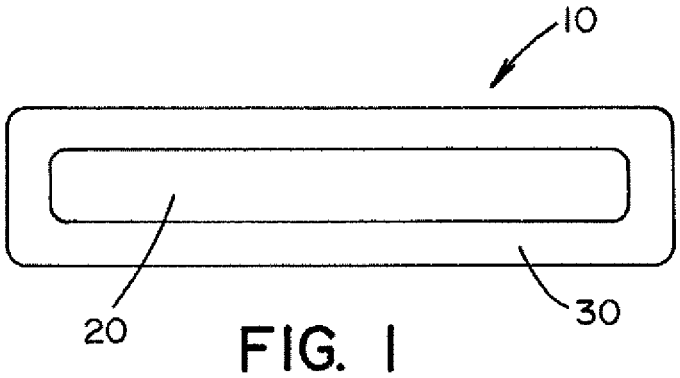
FIGS. 1-2 is a cross-sectional illustration of composite particles in accordance with the present invention wherein the black core represents the primary particle which can be a metal, metal alloy, and/or a ceramic particle, and the surrounding white section represents the additive/modifier which has been added to the surface of the primary particle in accordance with the present invention.
Figure 2:
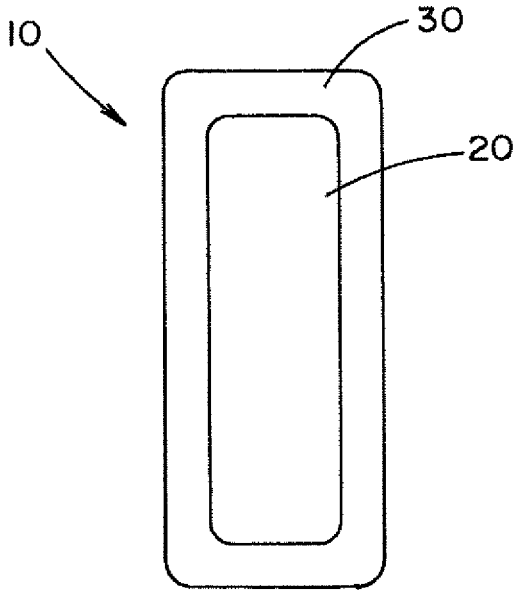

In accordance with the present invention, a metal, metal alloy, and/or ceramic particle, typically used for powder metallurgy fabrication, is provided which is made from a primary particle which has a thin, continuous or non-continuous coating of a reactive matrix and/or binder used to improve the consolidation behavior, properties of the resultant powder metallurgy compact, and/or to provide controlled response to external stimuli. The coated particle is comprised of a metal, metal alloy, and/or a ceramic particle, to which has been applied a surface coating of at least about 1% of the primary particle diameter, typically no more than about 50% of the primary particle diameter (e.g., 1%, 1.01%, 1.02% . . . 49.98%, 49.99%, 50%) and any valve or range therebetween, and still more typically about 1 to 40% of the primary particle diameter using any applicable technique such as, but not limited to CVD, plating, spray-cladding, solution precipitation, mechanochemical cladding, electrostatic agglomeration, etc. FIGS. 1-2 are illustrations of non-limiting coated particles 10 in accordance with the present invention. The primary or core particle 20 is designed in black and the coating of a reactive matrix and/or binder 30 is illustrated as the white layer about the primary or core particle.

The relative interfacial area between the core and the coating is controlled to provide for a controlled reaction rate. This rate may be further augmented by the production of a dual-phase matrix/binder having a much higher interfacial area than the coarser core particles; however, this is not required.

The starting material is a metal, metal alloy, and/or ceramic particle having an average particle diameter size of at least about 0.1 microns, typically no more than about 500 microns (e.g., 0.1 microns, 0.1001 microns, 0.1002 microns 499.9998 microns, 499.9999 microns, 500 microns) and including any value or range therebetween, more typically about 0.1 to 400 microns, and still more typically about 10 to 50 microns. The primary particles may be prepared through any number of synthesis routes including, but not limited to, gas and/or vacuum atomization, mechanical breakdown, gas precipitation and/or liquid precipitation, and/or other suitable techniques.

The starting primary particles are typically heat treated and/or etched to remove any adsorbed gases and/or surface oxide layers; however, this is not required. The primary particles are then coated with a metal, metal alloy, ceramic and/or composite layer. This layer serves to modify the mechanical properties and reactivity of the compact (i.e., particle plus coating), for example, by providing for an intermetallic or galvanic reaction with the primary particle and/or with interaction with secondary particles added during consolidation. Also, in accordance with the present invention, the particle coating may prevent reoxidation of the primary particle, limit reaction of the particle with a metal matrix, and/or modify the diffusional properties (i.e., grain growth, grain boundary strength, etc.) of the particle when consolidated.

In accordance with the present invention, the formation of the coated particles may be accomplished by applying either a single layer of a metal, metal alloy, ceramic and/or composite coating, and/or a multilayer or composite coating system. Additional particles of a finer size (i.e., small average diameter size) than the primary particle or the coated particles may further be added during consolidation to reduce cost, and/or modify the mechanical or reactive functions of the reactive matrix (i.e., primary particle plus coating or primary particle plus coating plus finer additional particles). The coating can have a thickness that is neither too thin nor too thick. A thicker coating facilitates wetting of the particles during consolidation. On the other hand, too thick a coating will reduce the concentration of the primary particles, reduce the dissolution rate of the matrix in a controlled electrolytic reaction, and/or may result in detrimental effects on the final compact properties. Typically, the coating is at least about 1% of the primary particle diameter, typically no more than about 50% primary particle diameter (e.g., 1%, 1.01%, 1.02% . . . 49.98%, 49.99%, 50%) and any value or range therebetween, and typically about 1 to 30% of the primary particle diameter. Also or alternatively, the coating is at least about 0.01 microns thick, typically no more than about 10 microns thick (e.g., 0.01 microns, 0.01001 microns, 0.01002 microns . . . 9.9998 microns, 9.9999 microns, 10 microns) and any value or range therebetween, and more typically about 0.1 to 5 microns thick. In one non-limiting embodiment of the invention, the primary or core particle can be deformable during consolidation to promote the formation of a space-filling array of repeating engineered particle units; however, this is not required.

In one non-limiting embodiment of the invention, the particles include aluminum particles having an average particle diameter size of about 5 to 50 microns (e.g., 5 microns, 5.01 microns, 5.02 microns . . . 49.98 microns, 49.99 microns, 50 microns) and any value or range therebetween, that are degassed and/or deoxidized, and then coated with about 0.3 to 2 microns coating thickness (e.g., 0.3 microns, 0.301 microns, 0.302 microns 1.998 microns, 1.999 microns, 2 microns) and any value or range therebetween, of silicon, silver, and/or zinc. In another non-limiting embodiment, smaller or larger particles can be coated with thicker or thinner coatings. As can be appreciated, multilayer coatings can be applied to one or more of the primary or core particles.

In still another embodiment, the primary or core particles include iron and/or carbon particles having an average particle diameter size of about 5 to 50 microns (e.g., 5 microns, 5.01 microns, 5.02 microns . . . 49.98 microns, 49.99 microns, 50 microns) and any value or range therebetween, that are coated with about 0.3 to 3 microns coating thickness (e.g., 0.3 microns, 0.301 microns, 0.302 microns . . . 2.998 microns, 2.999 microns, 3 microns) and any value or range therebetween, of a matrix of magnesium and/or zinc. The consolidated compact reacts when activated by an electrolyte, with the reactive binder dissolving at a controlled rate. Having a high surface area of the cathode (iron and/or graphite) and a small area of the reactive binder can speed the reaction rate.

In yet another embodiment, a tungsten powder having an average particle diameter size of about 5 to 100 microns (e.g., 5 microns, 5.01 microns, 5.02 microns . . . 99.98 microns, 99.99 microns, 100 microns) and any value or range therebetween, is coated with about 0.3 to 3 microns coating thickness (e.g., 0.3 microns, 0.301 microns, 0.302 microns . . . 2.998 microns, 2.999 microns, 3 microns) and any value or range therebetween, of zinc and/or magnesium, followed by powder forging or spark plasma sintering to form a high density reactive matrix composite. This high density composite can be activated by vaporizing the zinc and/or magnesium upon high velocity impact, wherein the magnesium and/or zinc vapor reacts with the air that can produce a secondary explosion or deflagration thermal event.

In still yet another embodiment, a high density reactive material such as silicon, boron, and/or tantalum having an average particle diameter size of about 5 to 100 microns (e.g., 5 microns, 5.01 microns, 5.02 microns . . . 99.98 microns, 99.99 microns, 100 microns) and any value or range therebetween, is coated with about 0.3 to 3 microns coating thickness (e.g., 0.3 microns, 0.301 microns, 0.302 microns . . . 2.998 microns, 2.999 microns, 3 microns) and any value or range therebetween, of a reactive composite binder (e.g., aluminum, magnesium, etc.) and an oxidizer (e.g., fluorinated polymer, etc.) having a coating thickness of about 0.01 to 3 microns coating thickness (e.g., 0.01 microns, 0.01001 microns, 0.01002 microns . . . 2.998 microns, 2.999 microns, 3 microns) and any value or range therebetween. The reactive composite binder can optionally be designed to rapidly ignite upon a thermal stimulus (e.g., a fuse, via high velocity impact, etc.), dispersing and igniting the core particles which produce a secondary reaction. The core particles are normally not ignitable without the preheating and dispersion created by the reactive composite coating; however, this is not required.

In still a further embodiment, the reactivity of an electrolytically activated reactive composite of magnesium and/or zinc and iron is controlled to produce a dissolution rate from about 1 to 10 mm/day and any value or range therebetween, by controlling the relative phase amounts and interfacial surface area of the two galvanically active phases. In one non-limiting example, a mechanical mixture of iron and/or graphite and/or and zinc and/or magnesium is prepared and applied to the surface of about 30 to 200 micron and any value or range therebetween of iron and/or graphite particles, followed by consolidation using spark plasma sintering or powder forging at a temperature below the magnesium and/or zinc melting point. The resultant structure has an accelerated rate of reaction due to the high exposed surface area of the iron and/or graphite cathode phase, but low relative area of the anodic (zinc and/or magnesium) reactive binder.

Figure 3A:
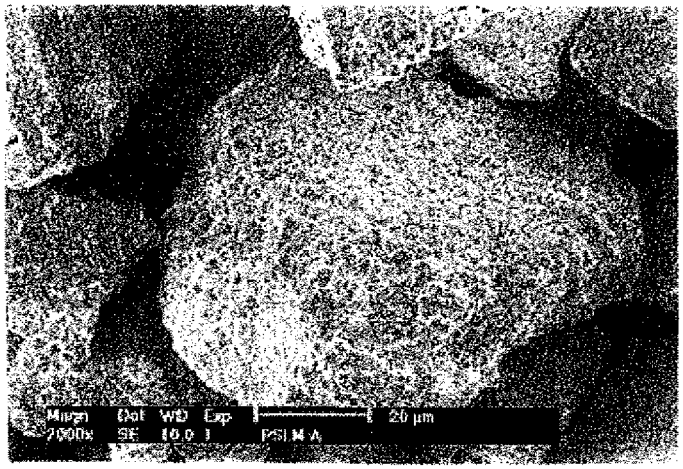
FIGS. 3A-3C illustrate magnesium-coated graphite, a consolidated magnesium-graphite part in its microstructure respectively, in accordance with the present invention.
Figure 3B:
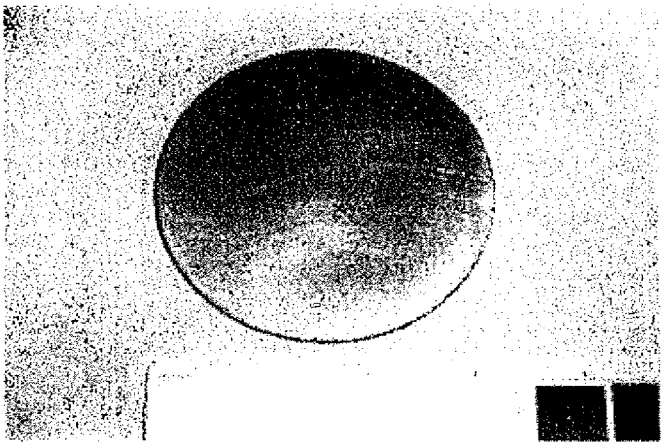
Figure 3C:
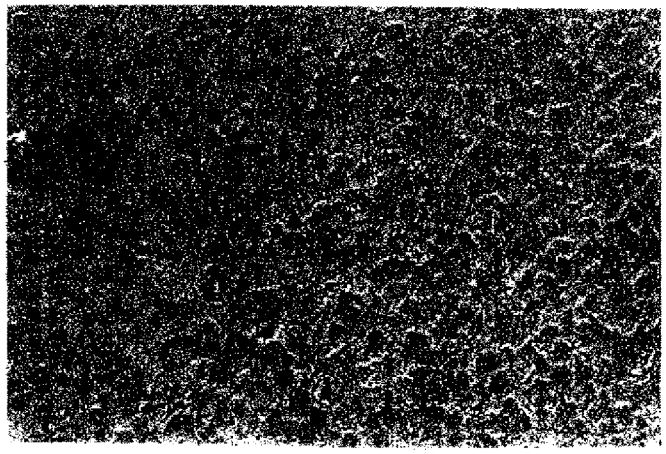
Figure 4:
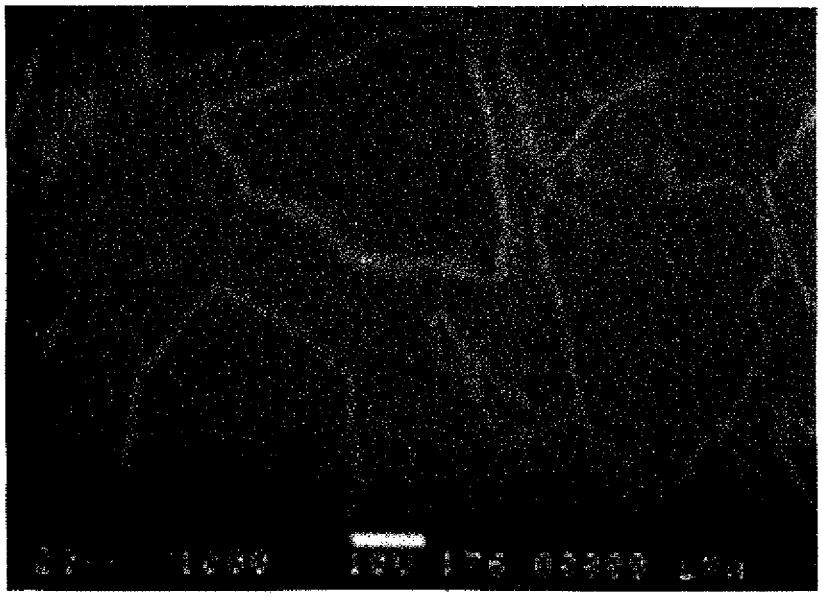
FIG. 4 illustrates a magnesium-iron-graphite reactive composite microstructure in accordance with the present invention; and, FIG. 5 is a schematic diagram showing carbon particles embedded in a matrix of magnesium alloy with an iron interface, along with an actual composite structure, wherein the carbon particles (black) are first coated with a wetting and reaction accelerator (iron) and then with an activator (slightly darker shade), and these composite powders are then embedded in a matrix of magnesium alloy using powder metallurgy techniques.

These non-limiting examples of the invention lead to an excellent material for powder metallurgical processing. FIGS. 3A-3C and 4 illustrate a representative microstructure for a magnesium-graphite composite and a magnesium-iron-graphite composite. FIG. 3A is a magnified picture of magnesium-coated graphite. FIG. 3B is consolidated magnesium-graphite part. FIG. 3C is a magnified view of the microstructure of the magnesium-graphite part of FIG. 3B. FIG. 4 is a magnified view of a magnesium-iron-graphite reactive composite microstructure.

Figure 5:
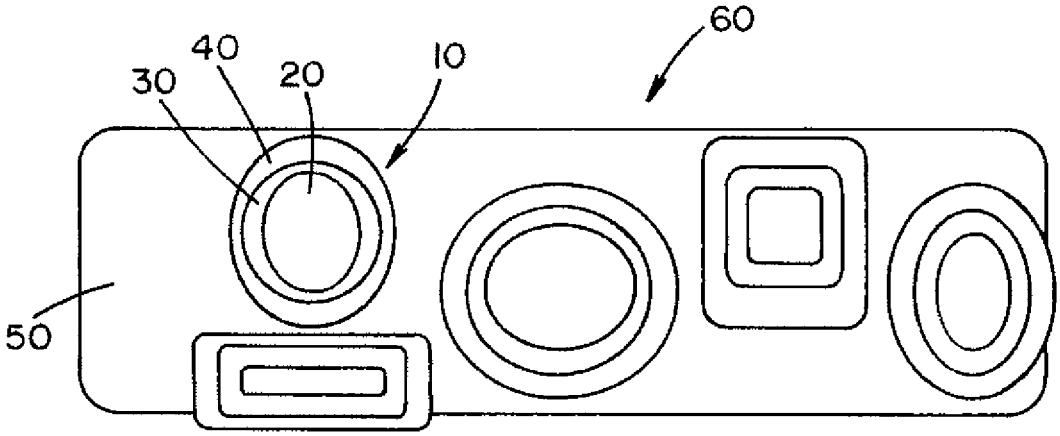

FIG. 5 is a schematic diagram showing a composite particle 10 formed of primary or core particles, such as, but not limited to, carbon particles, embedded in a matrix of coating of, but not limited to, a magnesium alloy with an interface of, but not limited to, iron, along with an actual composite structure. The primary or core particles 20 are illustrated as the black colored core. The primary or core particles are first coated with a wetting and reaction accelerator (e.g., iron, etc.) 30 which is illustrated as the white colored coating layer about the primary or core particles. An activator 40 is subsequently coated onto the wetting and reaction accelerator layer, which activator layer is illustrated as the slightly darker shade or grey colored layer about the white colored wetting and reaction accelerator layer. The coating thicknesses of the wetting and reaction accelerator layer and the activator layer can be the same or different. All three layers of the composite particle are generally formed of a different material; however, two non-adjacently positioned layers can be formed of the same material. The composite particle can have the same shape and/or size; however, this is not required. A plurality of composite particles 10 are illustrated as being embedded in a matrix of material 50 such as, but not limited, to magnesium alloy to form a matrix composite material 60. The process of embedding the composite particles in the matrix material to form the matrix composite material can be by use of powder metallurgy techniques.

Example 1

Iron powder having a particle size of about 20 to 40 microns is loaded into a fluidized bed reactor. Magnesium metal vapor is then introduced into the reactor and condenses to form a magnesium coating on the iron particles. About 8 to 12% by volume (e.g., 10% by volume) of magnesium is added to the iron powder. The resultant magnesium coated iron powder is then consolidated into a billet, and powder forged into a final shape at about 380 to 480° C. under about 30 to 100 tons/in$^2$ compaction pressure.

The resultant compact has high mechanical properties, generally above 30 KSI strength, and when exposed to slightly acidic or salt solutions, is corroded at a rate of 0.1-15 mm/day depending on environment and temperature.

Example 2

Magnesium powder is dry-milled under inert atmosphere with about 10 to 60% by volume of 1 to 3 microns carbonyl iron powder (a composite of iron and carbon) and a small amount of catalyst (iron aluminide is one example) to produce a composite powder blend. Additionally, coarse iron powder (as in Example 1) is loaded into a fluidized bed reactor, and the milled magnesium-iron-carbon is then applied to the surface of the coarse graphite powder by spraying a solution of the magnesium powder, a binder, and a liquid carrier onto the surface of the powder in a fluidized bed. Thereafter is the addition of about 8 to 22% by volume magnesium composite powder. The resultant composite powder is consolidated using spark plasma sintering or powder forging with 20-40% upset to form a fully dense compact, which is machined into galvanically activated reactive composite parts having a dissolution rate of about 0.1 to 5 mm/hour in a brine solution.

Example 3

Silicon, titanium, or zirconium metal powder having a particle size of about 10 to 50 microns is loaded into a fluidized bed. A mixture of fine magnesium powder and polyvinylidene difluoride (PVDF) in a solvent is applied as a surface coating onto the silicon powder and the solvent is removed. The resultant powder is warm-compacted to form a high density reactive metal matrix composite having a strength greater than 10 KSI, and which can be initiated to disperse, react, and produce a high energy blast effect using an external stimulus such as hard target penetration or electrically stimulated to generate heat and disintegrate rapidly.

Example 4

Tungsten powder having a particle size of about 10 to 20 microns is placed into a fluidized bed and coated with a mixture of titanium and boron powders with an atomic ratio of about 0.5-2:1. The resultant coated particles are cold-pressed, outgased, and powder forged or spark plasma sintered into a conical structure. This reactive cone is able to be explosively formed into a reactive slug which provides excellent penetration into tight formations to release oil and gas concentrations, self-heating itself to over 800 C and providing a high density slug with excellent penetration characteristics.

Example 5

A magnesium or zinc coating is applied using vapor deposition to an oxidizer core, which can be iron oxide, KClO4, AgNO3, or Bi2O3 or other oxidizer particle, having a size between 1 and 50 microns, and preferably between 10 and 25 microns. These powders are then further blended with 5-30V % of a thermoplastic fluorinated polymeric material such as PVDF or PTFE. The resultant blended mixture is warm compacted or molded to form a fully dense (greater than 95% dense) compact having mechanical properties of greater than 5,000 PSIG flexure strength and a high energy density that can be triggered to give a large thermal or gas pressure response using an electrical or thermal signal.

Example 6

A magnesium or zinc coating is applied using vapor deposition to a 1-50 micron graphite, metal, or ceramic core particle to form a 0.1-3 micron thick Mg coating. The coated core particles are warm-compacted or pressed and sintered to form a porous perform having between 10 and 50% open porosity, but near-zero "touching" of the ceramic or metallic core particles. This controlled density perform is then melt-infiltrated with aluminum, magnesium alloy, aluminum-magnesium alloy, or zinc alloy to form a reactive metal matrix composite having a strength above 8000 psig, and meeting predetermined dissolution or reactive rates, where such reactivity is controlled by controlling the relative amounts of phases and the size and composition of the starting core particles.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A method for forming a dissolvable device for use in a downhole application comprising:

providing a reactive matrix composite, said reactive matrix composite comprising a plurality of porous preformed particles, each of said porous preformed particles formed of a plurality of coated particles that have been sintered together, each of said coated particles formed of a primary core and a reactive binder that is coated on said primary core, said primary core and said reactive binder formed of different materials, said primary core formed of a) a metal that includes one or more materials selected from the group consisting of titanium, boron, hafnium, niobium, silver, tungsten, and zirconium, b) carbon or c) ceramic, said coating thickness of said reactive binder is less than a particle diameter of said primary core, reactive binder includes one or more materials selected from the group consisting of silicon, silver, zinc, magnesium, aluminum, iron, graphite, titanium, zirconium, tantalum, hafnium, tungsten, molybdenum, chrome, boron, manganese, silicon, germanium, iron-aluminum, magnesium-iron, magnesium-carbon, aluminum-carbon, nickel-aluminum, titanium-boron, boron, calcium, sodium, carbonyl iron, and lithium, said primary core constitutes about 30-90% by volume of said coated particle, said primary core has an average particle diameter of about 0.1-500 microns; and, forming said reactive matrix composite such that said dissolvable device is at least partially formed of said reactive matrix composite, said reactive matrix composite having a dissolution rate of about 0.1-5 mm/hour in a brine solution, said reactive matrix composite having a strength that is greater than 8000 psig, said dissolvable device is in the form of a proppant, frac ball, valve, plug, ball, or sleeve.

2. The method as defined in claim 1, wherein said coating thickness of said reactive binder is less than 50% of a particle diameter of said primary core, said primary core has an average particle diameter of about 0.1-500 microns.

3. The method as defined in claim 1, wherein said reactive binder has a coating thickness of 0.01-50 microns prior to formation of said reactive matrix composite.

4. The method as defined in claim 1, wherein each of said porous preformed particles has 10-50% open porosity.

5. The method as defined in claim 1, wherein said primary core includes i) said ceramic wherein said ceramic includes one or more materials selected from the group consisting of $KClO_4$, $AgNO_3$, and $Bi_2O_3$; or ii) said carbon wherein said carbon includes one or more materials selected from the group consisting of graphite, carbonyl iron powder, iron-coated carbon fiber, nickel-coated carbon fiber, and/or milled graphite fiber.

6. The method as defined in claim 1, wherein said reactive binder includes one or more materials selected from the group consisting of zinc, magnesium, aluminum, carbonyl iron, titanium, magnesium-iron, magnesium-carbon, titanium-boron, and boron.

7. The method as defined in claim 1, wherein said reactive binder includes a composite of a reactive material and an oxidizer, said reactive material including one or more materials from the group consisting of magnesium, zirconium, tantalum, titanium, hafnium, calcium, tungsten, molybdenum, chrome, manganese, silicon, germanium and aluminum, said oxidizer including one or more materials from the group consisting of fluorinated polymer and chlorinated polymer, bismuth oxide, potassium perchlorate, potassium nitrate silver nitrate, iron oxide, tungsten oxide, molybdenum oxide, boron, aluminum, and silicon.

8. The method as defined in claim 1, wherein said reactive binder includes a composite of a fuel, an oxidizer, and a reactive polymeric material.

9. The method as defined in claim 8, wherein said reactive polymeric material includes aluminum-potassium perchlorate-polyvinylidene difluoride.

10. The method as defined in claim 1, wherein said reactive matric composite further includes a catalyst addition, said catalyst includes one or more materials selected from the group consisting of solid additives such as sulfur, phosphorous, tin, lead, bismuth, iron aluminide, metal salts, and oxides or intermetallic compounds having low melting points below 500° C.

11. The method as defined in claim 1, wherein said reactive matric composite further includes a secondary coating, said secondary coating formed of a different material from said reactive binder and said primary core, said secondary coating positioned between said primary core and said reactive binder or on an outer surface of said reactive binder.

12. The method as defined in claim 1, wherein said reactive binder includes two materials selected from the group consisting of zinc, aluminum, magnesium, iron-aluminum, nickel-aluminum, titanium-boron, zirconium, tantalum, titanium, hafnium, calcium, tungsten, molybdenum, chrome, manganese, silicon, and germanium.

13. The method as defined in claim 1, wherein said reactive binder includes an oxidizer, said oxidizer including one or more materials from the group consisting of fluorinated polymer and chlorinated polymer, bismuth oxide, potassium perchlorate, potassium nitrate, silver nitrate, iron oxide, tungsten oxide, molybdenum oxide, boron, aluminum, and silicon.

14. The method as defined in claim 1, wherein said reactive binder includes a reactive polymeric material, said reactive polymeric material includes polyvinylidene difluoride.

15. A method for forming a dissolvable device for use in a downhole application comprising:

providing a reactive matrix composite; said reactive matrix composite comprising a plurality of porous preformed particles; each of said porous preformed particles formed of a plurality of coated particles that have been sintered together or consolidated under pressure; each of said coated particles formed of a primary core and a reactive binder that is coated on said primary core; said primary core and said reactive binder formed of different materials; said coating thickness of said reactive binder is less than a particle diameter of said primary core; said primary core including a material selected from the group consisting of a) ceramic and/or oxide and wherein said ceramic and/or oxide includes one or more materials selected from the group consisting of iron oxide, $KClO_4$, $AgNO_3$, and $Bi_2O_3$, and b) carbon and wherein said carbon includes one or more materials selected from the group consisting of graphite, carbonyl iron powder, iron-coated carbon fiber, nickel-coated carbon fiber, and milled graphite fiber; said reactive binder includes one or more materials selected from the group consisting of silicon, silver, zinc, magnesium, aluminum, iron, graphite, titanium, zirconium, tantalum, hafnium, tungsten, molybdenum, chrome, boron, manganese, silicon, germanium, aluminum-iron, magnesium-iron, magnesium-carbon, aluminum-carbon, nickel-aluminum, titanium-boron, calcium, sodium, carbonyl iron, and lithium; said primary core constitutes about 30-90% by volume of said coated particle, said primary core has an average particle diameter of about 0.1-500 microns; and, forming said reactive matrix composite such that said dissolvable device is at least partially formed of said reactive matrix composite; said reactive matrix composite having a dissolution rate of about 0.1-5 mm/hour in a brine solution; said reactive matrix composite having a strength that is greater than 8000 psig, said dissolvable device is in the form of a proppant, frac ball, valve, plug, ball, or sleeve.

16. The method as defined in claim 15, wherein said primary core includes said carbon; said reactive binder includes one or more of magnesium, aluminum and zinc.

17. The method as defined in claim 16, further including a step of adding a catalyst to said coated particle.

18. The method as defined in claim 15, wherein said primary core includes said ceramic and/or oxide; said reactive binder includes one or more of magnesium, aluminum and zinc.

19. The method as defined in claim 15, wherein said primary core including said ceramic; said reactive binder includes one or more of magnesium, aluminum and zinc.

20. The method as defined in claim 1, wherein said primary core includes one or more of titanium and zirconium; said reactive binder includes one or more of magnesium, aluminum and zinc.

21. The method as defined in claim 20, further including a step of adding a catalyst to said coated particle.

22. The method as defined in claim 1, wherein said primary core includes tungsten; said reactive binder includes boron.

* * * * *